United States Patent [19]

Urabe

[11] Patent Number: 4,879,208

[45] Date of Patent: Nov. 7, 1989

[54] PROCESS FOR PREPARING SILVER HALIDE GRAINS

[75] Inventor: Shigeharu Urabe, Kanagawa, Japan

[73] Assignee: Fuji Photo Film Co., Ltd., Kanagawa, Japan

[21] Appl. No.: 298,446

[22] Filed: Jan. 18, 1989

[30] Foreign Application Priority Data

Jan. 18, 1988 [JP] Japan ..... 63-007851

[51] Int. Cl.[4] ..... G03C 1/00

[52] U.S. Cl. ..... 430/569

[58] Field of Search ..... 430/569

[56] References Cited

U.S. PATENT DOCUMENTS 4,336,328 6/1982 Brown et al. ..... 430/569

4,414,310 11/1983 Daubendick et al. ..... 430/567

*Primary Examiner*—Paul R. Michl

*Assistant Examiner*—Janet C. Baxter

*Attorney, Agent, or Firm*—Sughrue, Mion, Zinn, Macpeak & Seas

[57] ABSTRACT

A process for manufacturing uniform silver halide grains, which comprises the steps of:

(A) providing a mixer vessel and a reactor vessel, the mixer vessel being separate from the reactor vessel and the reactor vessel having contained therein an aqueous protective colloid solution and in which silver halide grains are grown;

(B) feeding an aqueous water-soluble silver salt solution, an aqueous water-soluble halide solution and an aqueous protective colloid solution into the mixer vessel;

(C) forming a fine silver halide grain-containing solution by mixing the thus fed solutions in the mixer vessel;

(D) immediately feeding the thus formed fine silver halide grain-containing solution into the reactor vessel; and (E) stirring said solution in the reactor vessel to grow uniform silver halide grains therein. By prohibiting the addition of the silver ions and the halide ions to the reactor vessel i the form of aqueous solutions, and the addition of the aqueous protective colloid solution containing the silver halide grains from the reactor vessel to the mixer vessel, formation and growth of uniform silver halide grains is achieved. An apparatus for performing the process of the present invention is also disclosed herein.

13 Claims, 2 Drawing Sheets

PROCESS FOR PREPARING SILVER HALIDE GRAINS

FIELD OF THE INVENTION

The present invention relates to a process for preparing silver halide grains. More precisely, it relates to a process for preparation of silver halide grains in which the halide composition in the silver halide crystal is completely uniform, the grains being free from halide distribution between them, as well as to an apparatus for the process.

BACKGROUND OF THE INVENTION

In general, silver halide grains are prepared by reacting an aqueous silver salt solution and an aqueous halide solution in an aqueous colloidal solution in a reactor. Precisely, there are known a single-jet method where a protective colloid such as gelatin and an aqueous halide solution are placed into a reactor and an aqueous silver salt solution is added thereto with stirring for a certain period of time, and a double-jet method where an aqueous gelatin solution is placed into a reactor and an aqueous halide solution and an aqueous silver salt solution are added thereto simultaneously. The double-jet method offers the advantage of allowing the formation of silver halide grains with a narrow grain size distribution, and the halide composition of the grains may freely be varied at various stages of growth of the grains by the double-jet method.

It is known that the growing speed of silver halide grains varies largely, depending upon the silver or halogen ion concentration in the reaction solution, the concentration of silver halide solvent therein, the distance between grains and the grain size. In particular, non-uniformity of the silver ion or halogen ion concentration derived from the aqueous silver salt solution and the aqueous halide solution added to a reactor cause a different growing speed in accordance with the different concentration of the respective ions and which results in a non-uniform silver halide emulsion. In order to overcome such non-uniformity in the final emulsion, it is necessary to rapidly and uniformly blend the aqueous silver salt solution and the aqueous halide solution, which are added to the aqueous colloidal solution, and react them together, so that the silver ion or halogen ion concentration in the reactor is uniform. In the conventional method of adding the aqueous silver halide solution and the aqueous silver salt solution to the surface of the aqueous colloidal solution in a reactor, the halogen ion and silver ion concentration are relatively high at and near the position to which the reaction solutions have been added, so that it is difficult to prepare uniform silver halide grains by this method. In order to overcome such local elevation of the concentration, the techniques illustrated in U.S. Pat. No. 3,415,650, British Patent 1,323,464 and U.S. Pat. No. 3,692,283 were developed. In accordance with these known means, a hollow rotary mixer is provided which has slits in the cylindrical wall and wherein the inside of the mixer is filled with an aqueous colloidal. More preferably the mixer is divided into an upper and lower room by a disc. The mixer is provided in a reactor vessel filled with an aqueous colloidal solution so that the rotary shaft of the mixer is vertical to the reactor vessel. An aqueous halide solution and an aqueous silver salt solution are fed into the mixer from the top and bottom open mouths through feeding ducts while the mixer is rapidly rotated so that the solutions are rapidly blended and reacted together. When the mixer has the separating disc, the aqueous halide solution and the aqueous silver salt solution as fed into the two rooms are diluted with the aqueous colloidal solution filled in each room, and these are rapidly blended and reacted near the outlet slits of the reactor. The silver halide grains formed by the reaction are expelled out into the aqueous colloidal solution in the reactor vessel because of the centrifugal force formed by the rotation of the mixer and the grains are grown in the colloidal solution in the reactor vessel.

On the other hand, JP-B-55-10545 (the term "J-PB" as used herein means an "examined Japanese patent publication") discloses a technique of improving the local distribution of the ion concentration to prevent the non-uniform growth of grains. In accordance with the method, a mixer filled with an aqueous colloidal silver is provided inside a reactor vessel which is filled with an aqueous colloidal solution. An aqueous halide solution and an aqueous silver salt solution are separately fed into the mixer through feeding ducts so that the reaction solutions are rapidly and vigorously stirred and blended by the lower stirring blades (turbine blades) as equipped in the mixer to form and grow silver halide grains. The grown silver halide grains are immediately expelled out from the mixer by the upper stirring blades, provided above the lower stirring blades, to the aqueous colloidal solution in the reactor vessel through the opening mouth as provided in the upper portion of the mixer.

JP-A-57-92523 (the term "JP-A" as used herein means an "unexamined published Japanese patent application") also discloses a means of overcoming the non-uniformity of the ion concentration. Precisely, a method of forming silver halide grains is described in which a mixer filled with an aqueous colloidal solution is provided in the inside of a reactor vessel filled with an aqueous colloidal solution. An aqueous halide solution and an aqueous silver salt solution are separately fed into the mixer from the opened bottom thereof, both reaction solutions are diluted with the aqueous colloidal solution and are rapidly stirred and blended by lower stirring blades provided in the mixer to form and grow silver halide grains in the mixer. The thus formed and grown silver halide grains are immediately expelled out from the upper opening mouth of the mixer to the aqueous colloidal solution in the reactor vessel. An apparatus for the method is also disclosed. The method and apparatus are characterized in that both reaction solutions diluted with the aqueous colloidal solution are passed through gaps between the inside wall of the mixer and the outer tops of the blades of the stirrer without being passed through the gaps between the blades of the stirrer so that the both reaction solutions are rapidly and vigorously sheared, blended and reacted in the gaps to give uniform silver halide grains.

In accordance with the above-mentioned methods and apparatuses, although the non-uniformity of the local concentration of silver ion and halogen ion in the reactor vessel can completely be overcome, nonuniformity of the concentration in the mixer still exists. In particular, there is a significant concentration distribution near the nozzle through which an aqueous silver salt solution and an aqueous halide solution are fed into the mixer, in the lower part of the stirring blades and in the stirring portion in the mixer. The silver halide grains fed into the mixer together with a protective colloid pass through the portion which have such non-uniform concentration distribution. Most importantly, the fed silver halide grains rapidly grow to large sizes in the portion. In accordance with the methods and apparatus, since the ion concentration distribution still is in the inside of the mixer and the grains rapidly grow in the mixer, the object of uniformly growing silver halide grains under the condition of substantially no concentration distribution can not be attained.

Further, in order to overcome non-uniform distribution of silver ion concentration and halogen ion concentration by more complete blending of the reaction solutions, a means of independently providing a reactor vessel and a mixer vessel and feeding an aqueous silver salt solution and an aqueous halide solution into the mixer vessel and rapidly blending them therein so as to form and grow silver halide grains has been proposed. For instance, JP-A-53-37414 and JP-B-48-21045 disclose a method of forming silver halide grains in which an aqueous protective colloid solution containing silver halide grains in a reactor vessel is circulated from the bottom of the vessel by a pump and a mixer vessel is provided in the course of the circulating system. An aqueous silver salt solution and an aqueous halide solution are fed into the mixer vessel, and both aqueous solutions are rapidly blended in the mixer vessel to grow the silver halide grains. An apparatus for the method is also disclosed. U.S. Pat. No 3,897,953 discloses a method of forming silver halide grains in which an aqueous protective colloid solution containing silver halide grains in a reactor vessel is circulated from the bottom of the vessel by a pump, and an aqueous halide solution and an aqueous silver salt solution are injected into the course of the circulating system by a pump. JP-A-53-47397 discloses a method of forming silver halide grains in which an aqueous protective colloid solution containing a silver halide emulsion in a reactor vessel is circulated therein by means of a pump. An aqueous alkali metal halide solution is first injected into the circulating system and allowed to diffuse therein until the system becomes uniform, and an aqueous silver salt solution is thereafter injected into the system to form silver halide grains. An apparatus for the method is also disclosed. In accordance with the methods, even if the flow rate of the aqueous solutions to be introduced into the circulating system in the reactor vessel and the stirring efficiency of the mixer vessel were controlled independently so that growth of silver halide grains could be conducted under the condition of a more uniform concentration distribution of the reaction solutions, the silver halide crystals transferred from the reactor vessel together with the aqueous protective colloid solution would rapidly grow in the portion of the inlet into which the aqueous silver salt solution and the aqueous halide solution are introduced. Accordingly, for of the same reason mentioned above, it would be impossible in practice to eliminate the concentration distribution in the mixing portion or near the inlet. That is, the object of uniformly growing silver halide under the condition of uniform concentration distribution could not be attained by the methods.

SUMMARY OF THE INVENTION

The object of the present invention is to overcome the problems associated with conventional methods and apparatus that silver halide grains are grown under the condition of non-uniform concentration of silver ion and halogen ion(s) whereby non-uniform emulsion grains having different grain sizes, different crystal habits, different halogen distributions in one grain or between plural grains, and different distributions of reduced silver nuclei in one grain or between plural grains are formed. The object of the present invention is attained by a process for manufacturing silver halide grains, which comprises the steps of:

(A) providing a mixer vessel outside a reactor vessel which has contained therein an aqueous protective colloid solution and in which silver halide grains are grown;

(B) feeding an aqueous water-soluble silver salt solution, an aqueous water-soluble halide solution and an aqueous protective colloid solution into the mixer vessel;

(C) forming a fine silver halide grain-containing solution by mixing the thus fed solutions in the mixer vessel;

(D) immediately feeding the thus formed fine silver halide grain-containing solution into the reactor vessel; and (E) stirring the fine silver halide grain-containing solution in the reactor vessel to grow silver halide grains therein.

The important feature in the process is that the aqueous silver salt solution and the aqueous halide solution are not added to the reactor vessel and that the aqueous protective colloid solution containing silver halide grains in the reactor vessel is not circulated into the mixer vessel. In this respect, the process of the present invention is novel and distinct from the conventional methods.

DETAILED DESCRIPTION OF THE INVENTION

Figure 1:
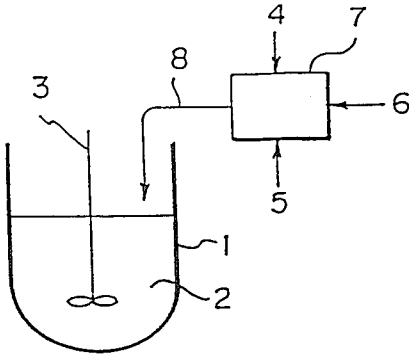
FIG. 1 is a schematic view of an apparatus in which the process of the present invention can be performed.

A silver nitrate solution is preferred as the aqueous water-soluble silver salt solution used in the process of the present invention.

In accordance with the process of the present invention, formation of silver halide nuclei is first conducted in the reactor vessel containing an aqueous protective colloid solution. The nuclei formation may be effected by following conventional means.

Precisely, nuclei of silver halide grains for the present invention may be prepared by the methods described in P. Glafkides, *Chimie et Physique Photoqraphique* (published by Paul Montel, 1967), G. F. Duffin, *Photoqraphic Emulsion Chemistry* (published by the Focal Press, 1966) and V.L. Zelikman et al, *Making and Coating Photographic Emulsion* (published by The Focal Press, 1964). For example, the nuclei may be prepared by an acid method, a neutralization method, an ammonia method, etc. Also, as a method of reacting a soluble silver salt and soluble halide(s), a single jet method, a double jet method, or a combination thereof may be used.

A so-called reverse mixing method capable of forming silver halide grains in the presence of an excess of silver ions can also be employed. As one system of the double jet method, a so-called controlled double jet method of keeping a constant pAg in a liquid phase of forming silver halide grains can also be employed. According to the method, a silver halide emulsion containing silver halide grains having a regular crystal form and substantially uniform grain sizes can be obtained.

Two or more kinds of silver halide emulsions separately prepared can be blended for use in the present invention.

In preparation of the silver halide grain nuclei for use in the present invention, it is preferred that the nuclei prepared have a uniform halogen composition. For preparation of silver halide grains where the core nucleus is silver iodobromide, a double jet method or controlled double jet method is preferably employed.

Although varying in accordance with the reaction temperature and the kind of the silver halide solvent used, the pAg value in preparation of the silver halide nuclei for the present invention is preferably from 7 to 11. The pH value in preparation of the nuclei is preferably from 2 to 11. In preparation of the nuclei, use of silver halide solvents is preferred because the time for formation of silver halide grains may be shortened. For instance, generally well known silver halide solvents such as ammonia or thioether may be used for this purpose.

Regarding the shape of the silver halide nuclei, the nuclei may be tabular, spherical or twin-shaped, or these may also be octahedral cubic or tetradecahedral, or may further be in a mixed system thereof.

The nuclei may be polydispersed or monodispersed, but they are more preferably monodispersed. "Monodispersed nuclei" as herein referred to have a coefficient of variation in grain sizes of 20% or less.

In order that the silver halide grains may have a uniform grain size, a method of varying or properly controlling the adding speed of silver nitrate or aqueous alkali halide solution in accordance with the growing speed of the silver halide grains formed, for example, as described in British Patent 1,535,016 and JP-B-48-36890 and JP-B-52-16364, and a method of varying the concentration of the aqueous solutions to be added, for example, as described in U.S. Patent 4,242,445 and JP-A-55-158124 are preferably employed so that the grains may rapidly be grown within the range not exceeding the critical supersaturation degree for the reaction system. In accordance with these methods, re-nucleation hardly occurs and the individual silver halide grain can be uniformly coated for growing. These methods are also preferably used in the case where the coating layer, mentioned hereinafter, is to be introduced into the grain.

In the step of forming nuclei of the silver halide grains and in the step of physical ripening of the grains, a cadmium salt, a zinc salt, a lead salt, a thallium salt, an iridium salt or a complex salt thereof, a rhodium salt or a complex salt thereof, or an iron salt or a complex salt thereof may be incorporated into the reaction system.

After the silver halide grain nuclei have been formed in the reactor vessel as mentioned above, the nuclei are grown by the method of the present invention. Alternatively, silver halide grains to be grown as grain nuclei may be previously prepared a nd the grain nuclei-containing emulsion be re-dissolved and added to the reactor vessel, in place of preparing the nuclei in the reactor vessel.

In place of using the nuclei-containing emulsion, nuclei may be previously prepared and grown and the grown grains be re-dissolved and added to the reactor vessel so that they may be used as core grains. The core grains may thereafter be grown in the reactor vessel by the method of the present invention. After the grains have been grown by the method of the present invention, they may optionally be further grown by a conventional method, if desired, for example, by adding aqueous silver nitrate and halide solutions to the grains-containing reactor vessel.

One embodiment of the method of growing silver halide grains by the process of the present invention is illustrated by FIG. 1.

In FIG. 1, reactor vessel (1) has aqueous protective colloid solution (2). The aqueous protective colloid solution is stirred and blended by propeller (3) with rotary shaft. After silver halide grains which are nuclei have previously been added to the reactor vessel or after nuclei have previously been formed therein, an aqueous silver salt solution, an aqueous halide solution and an aqueous protective colloid solution are added to mixer vessel (7) provided outside and separate from the reactor vessel through feeding lines (4), (5) and (6), respectively. In this case, the aqueous protective colloid solution may be blended with the aqueous halide solution and/or aqueous silver salt solution before adding. These solutions are rapidly and strongly blended in the mixer vessel, and immediately thereafter the resulting mixture is continuously introduced into the reactor vessel through ejecting outlet line (8).

Figure 2:
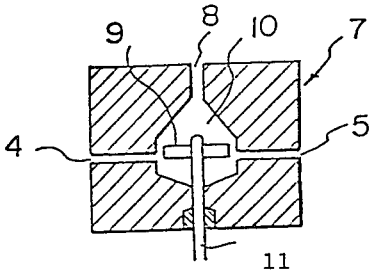
FIG. 2 is a sectional view of a mixer vessel used in the process of the present invention.

FIG. 2 shows the details of mixer vessel (7). Mixer vessel (7) has reaction chamber (10) therein, and stirring blade (9) with rotary shaft (11) is provided in the inside of reaction chamber (10). The aqueous silver salt solution, aqueous halide solution and aqueous protective colloid solution are added to reaction chamber (10) through the three feeding inlets (4, 5 and one more not shown). By rapidly rotating the rotary shaft at a high speed, for example at 1000 r.p.m. or more, preferably 2000 r.p.m. or more, more preferably 3000 r.p.m. or more, the reaction system is vigorously and strongly blended, and the solution containing extremely fine grains thus formed is immediately expelled from ejecting outlet (8) into the reactor vessel. As the grain size of the grains thus introduced into the reactor vessel are fine and small as mentioned hereinafter, the grains may easily be dissolved in the aqueous colloid solution in the reactor vessel to dissociated into silver ions and halogen ion(s), so that these may grow into uniform silver halide grains. The halide composition of the fine grains is preferably the same as the halide composition of the silver halide grains finally obtained. The fine grains introduced into the reactor vessel diffuse throughout the interior of the reactor vessel because of the stirring of the contents in the reactor vessel, and the halogen ion(s) and silver ions dissociate from the respective fine grains. Since the grains formed in the mixer vessel are extremely fine and the number of the grains is extremely large, and additionally since the respective silver ions and halogen ions (in the case of forming mixed crystals, the latter are in the form of the intended halogen ion composition) are dissociated from such extremely large amount of grains and diffuse throughout the protective colloid in the reactor vessel, completely uniform silver halide grains can thereby be formed in accordance with the process of the present invention. The crux of the process of the present invention is that neither the silver ion nor the halogen ion(s) is added to the reactor vessel in the form of aqueous solutions by any means and that the aqueous protective colloid solution in the reactor vessel is not circulated into the mixer vessel by any means. In this respect, the process of the present invention is novel and distinct from conventional processes, and provides an unexpected effect of forming and growing uniform silver halide grains.

The fine grains formed in the mixer vessel have an extremely high solubility because of the extremely small grain size thereof, so that these become re-dissolved when added to the reactor vessel, dissociating into silver ions and halogen ions and are then deposited on to the grains previously existing in the reactor vessel, thereby causing the grains to grow. The fine grains undergo so-called Ostwald ripening between them because of the high solubility of the grains, causing an increase of the grain size of the thus ripened grains. Increase in the size of the fine grains would cause a decrease in the solubility thereof, so that the dissolution speed of the grains in the reactor vessel would be retarded and the growing speed of the grains would thereby be extremely decreased. As the case may be, the grains cannot be dissolved, and rather they themselves may be nuclei to be grown.

In accordance with the present invention, the problem can be overcome by the following three techniques.

(1) After the fine grains have been formed in the mixer vessel, they are immediately added to the reactor vessel.

As mentioned in detail hereunder, a method has hitherto been known where fine grains are previously formed to give a fine grains-containing emulsion, the grains are re-dissolved, and the resulting fine grains-containing emulsion is added to a reactor vessel containing silver halide grains which are to be nuclei and also containing a silver halide solvent therein, so that the nuclei grains are grown in the vessel. In such a method, however, the extremely fine grains once formed undergo Ostwald ripening in the steps of grain formation, washing with water, re-dispersion and re-dissolution so that the grain size of the resulting grains would increase. In the system of the present invention, on the other hand, the mixer vessel is provided close to the reactor vessel so that the residence time of the reaction solutions in the mixer vessel is shortened. Accordingly, the fine grains formed in the mixer vessel may immediately be introduced into the reactor vessel, whereby the Ostwald ripening is prevented. Specifically, the residence time (t) of the solutions added to the mixer vessel is represented by the following formula:

$$t = \frac{v}{a + b + c} \quad \text{(I)}$$

wherein v is the volume of the reaction chamber in the mixer vessel (ml);

a is the amount of the silver salt solution added (ml/min);

b is the amount of the halide solution added (ml/min); and c is the amount of the protective colloid solution added (ml/min).

In the process of the present invention, (t) is 10 minutes or less, preferably 5 minutes or less, more preferably 1 minute or less, and most preferably 20 seconds or less. Accordingly, the fine grains formed in the mixer vessel may directly and immediately be introduced into the reactor vessel without the grain size thereof increasing further.

(2) Strong and efficient stirring is effected in the mixer vessel.

T. H. James, *The Theory of the Photographic Process,* at page 93 discloses that "Another form in addition to Ostwald ripening is coalescence. In coalescence ripening, crystals which have been far remote from one another before this are directly contacted and fused together to give greater crystals so that the grain size of the thus fused grains rapidly varies thereby. Both Ostwald ripening and coalescence ripening occur not only after deposition but also during deposition." Coalescence ripening as referred to in the literature easily occurs especially when the grain size is extremely small, and more particularly when stirring is insufficient. In an extreme case, coalescence ripening often causes formation of crude bulky grains. In accordance with the process of the present invention, since the closed-type mixer vessel as shown in FIG. 2 is used, the stirring blades in the reactor vessel may be rotated at a high rotation speed. Accordingly, strong and highly efficient stirring and mixing can be effected by the process of the present invention, although such could not be effected using a conventional open-type reactor vessel. In conventional open-type reactor vessels, if the stirring blades are rotated at a high rotation speed, the reaction solution is scattered because of the centrifugal force by the high speed rotation, and further the reaction solution foams. Therefore, high speed rotation is impracticable in conventional open-type reactor vessels. Thus the above-mentioned coalescence ripening may be prevented in the process of the present invention and, as a result, fine grains having an extremely small grain size (i.e., 0.06 μm or less) can be obtained. Specifically, the rotation speed of the stirring blades in the process of the present invention is 1,000 r.p.m. or more, preferably 2,000 r.p.m. or more, and more preferably 3,000 r.p.m. or more.

(3) An aqueous protective colloid solution is injected into the mixer vessel.

The above-mentioned coalescence ripening may noticeably be prevented by adding a protective colloid to the fine silver halide grains. In accordance with the process of the present invention, the aqueous protective colloid solution is added to the mixer vessel by the following means.

(a) The aqueous protective colloid solution is singly injected into the mixer vessel by itself.

The concentration of the protective colloid may be 1% by weight or more, preferably 2% by weight or more, and the flow rate thereof is at least 20%, preferably at least 50%, more preferably 100% or more, of the sum of the flow rates of the aqueous silver salt solution and aqueous halide solution.

(b) The protective colloid is incorporated into the aqueous halide solution.

In this case the concentration of the protective colloid is 1% by weight or more, preferably 2% by weight or more.

(c) The protective colloid is incorporated into the aqueous silver salt solution.

Also in this case, the concentration of the protective colloid is 1% by weight or more, preferably 2% by weight or more.

When gelatin is used, silver gelatin is formed from silver ion and gelatin and this gives silver colloid by photolysis and pyrolysis. Accordingly, the silver salt nitrate solution and the protective colloid solution are better to be blended immediately before feeding into the mixer vessel.

The above-mentioned methods (a) to (c) may be employed singly or in combination thereof. If desired, all the three methods (a) to (c) may be employed simultaneously. As the protective colloid which is used in the process of the present invention, gelatin is generally used, but any other hydrophilic colloid may also be used. Specific examples are described in *Research Disclosure,* Vol. 176, Item 17643 (December, 1978), IX.

The grain size of the grains thus obtained by the technicfues (1) to (3) can be directly determined by transmission electromicroscopy, whereupon the magnification is preferably from 20,000 times to 40,000 times. The grain size of the fine grains of the present invention is 0.06 μm or less, preferably 0.03 μm or less, more preferably 0.01 μm or less.

U.S. Pat. No. 2,146,938 discloses a method of growing coarse grains in an emulsion by blending coarse grains on which nothing has been adsorbed and fine grains on which nothing has been adsorbed or by gradually adding a fine grains-containing emulsion to a coarse grains-containing emulsion. In this method, a fine grains-containing emulsion which has previously been prepared is added such that the method is distinct from the process of the present invention.

JP-A-57-23932 discloses a method of growing silver halide grains, in which a fine grains-containing emulsion prepared in the presence of a growth inhibitor is washed with water, dispersed and then re-dissolved, and the resulting solution is added to emulsion grains to be grown. However, the method is also distinct from the process of the present invention because of the same reason as mentioned above.

T. H. James, *The Theory of The Photographic Process,* (4th Ed.) refers to a Lippmann emulsion as an example of fine grains and discloses that the mean grain size of the grains is 0.05 μm. Preparation of fine grains having a grain size of 0.05 μm or less is possible, but if obtained, the grains would be unstable and would easily undergo Ostwald ripening thereby increasing the grain size of the resulting grains. In accordance with the method disclosed in JP-A-57-23932, adsorption of some substances to the fine grains would be somewhat effective for preventing Ostwald ripening to some degree. However, the dissolution speed of the resulting fine grains would be retarded because of the adsorption, which is contrary to the intended object of the present invention.

U.S. Pat. Nos. 3,317,322 and 3,206,313 disclose a method of forming core/shell grains, in which a silver halide grain emulsion containing chemically sensitized core grains having a mean grain size of at least 0.8 μm is blended with another silver halide grain emulsion containing silver halide grains which were not chemically sensitized and having a mean grain size of 0.4 μm or less and the resulting mixture is ripened to form shells over the cores. However, the method is also distinct from the process of the present invention, in that a previously prepared fine grains-containing emulsion is used and the two emulsions are blended and ripened in the former method.

JP-A-62-99751 discloses a photographic element containing silver bromide and silver iodobromide tabular silver halide grains having a mean diameter range of from 0.4 to 0.55 μm and an aspect ratio of 8 or more, and JP-A-62-115435 discloses the same element with the same grains having a mean grain size range of from 0.2 to 0.55 μm. In the example, there is illustrated a technique of growing tabular silver iodobromide grains, in which an aqueous silver nitrate solution and an aqueous potassium bromide solution are added to the reactor vessel in the presence of a protective colloid (bone gelatin) by a double-jet process while a silver iodide (AgI) emulsion (mean grain size: about 0.05 μm, bone gelatin: 40 g/mol of Ag) is simultaneously fed thereinto so that tabular silver iodobromide grains may be grown. In accordance with the method of the example, the aqueous silver nitrate solution and the aqueous potassium bromide solution are added to the reactor vessel simultaneously with addition of the fine silver iodide grains thereto. Thus, the method is distinct from the process of the present invention.

JP-A-58-113927 discloses (page 207) that "Silver, bromide and iodide may be introduced initially or during the growing stage of the grains in the form of fine silver halide grains as suspended in a dispersing medium. Concretely, silver bromide, silver iodide and/or silver iodobromide grains may be introduced for the purpose." The method also uses previously prepared fine grains-containing emulsion for addition, which is different from the process of the present invention.

JP-A-62-124500 discloses an example of growing host grains in a reactor vessel from previously prepared extremely fine grains put into the reactor. The method of the example also uses previously prepared fine grains-containing emulsion, which is different from the process of the present invention.

In the above-mentioned known methods, a fine grains-containing emulsion is previously prepared and the emulsion is re-dissolved, so that it is impossible to obtain fine grains having a small grain size. Accordingly, the grains having a relatively large grain size can not be rapidly dissolved in a reactor vessel, so that an extremely long period of time is required for complete dissolution of the grains or a large amount of silver halide solvent is necessarily required therefor. In this situation, the grains to be grown in the reactor vessel would have to be grown under an extremely low supersaturation condition and, as a result, the grain size distribution of the resulting grown grains would be unduly broad. Such broad grain size distribution would disadvantageously bring about the lowering of photographic gradation, lowering of sensitivity because of non-uniform chemical sensitization since large-sized grains and small-sized grains cannot be optimally chemically sensitized at the same time, increase of fog, worsening of graininess as well as deterioration of other various photographic properties. In addition, the known methods require many steps of grain formation, washing with water, dispersion, cooling, storage and re-dissolution, and therefore the manufacturing cost is high. Further, the addition of the emulsion is more limitative than addition of other solution. These problems may be solved by the process of the present invention whereby since extremely fine grains are introduced into the reactor vessel, the solubility of the fine grains is high and therefore the dissolution speed thereof is also high. Accordingly, the grains to be grown in the reactor vessel may be grown under a high supersaturation condition, so that the grain size distribution of the thus formed grown grains is not broadened. Moreover, the fine grains formed in the mixer vessel are directly introduced into the reactor vessel, so that the manufacture cost is economical.

In the process of the present invention, it is preferred to add a silver halide solvent to the reactor vessel, whereby the dissolution speed of the fine grains can be increased and the speed of growth of the grains in the reactor vessel can also be increased.

As examples of the silver halide solvent to be used for the purpose, there may be mentioned water-soluble bromides, water-soluble chlorides, thiocyanates, ammonia, thioethers and thioureas.

For example, there are thiocyanates (such as those described in U.S. Pat. Nos. 2,222,264, 2,448,534, and 3,320,069), ammonia, thioether compounds (such as those described in U.S. Pat. Nos. 3,271,157, 3,574,628, 3,704,130, 4,297,439, and 4,276,347), thione compounds (such as those described in JP-A-53-144319, JP-A-5382408, and JP-A-55-77737}, amine compounds (such as those described in JP-A-54-100717), thiourea derivatives (such as those described in JP-A-55-2982), imidazoles (such as those described in JP-A-54-100717), substituted mercaptotetrazoles (such as those described in JP-A-57-202531), etc.

In accordance with the process of the present invention, the feeding speed of silver ion and halide ion(s) to the mixer vessel may freely be controlled. The ions may be fed at a constant feeding speed, but preferably, the feeding speed is accelerated. The method is described in JP-B-48-36890 and JP-B-52-16364, the disclosures of which are hereby incorporated by reference. Further in accordance with the process of the present invention, the halogen composition of growing silver halide grains may freely be controlled during growth thereof. For example, in the case of silver iodobromide, a constant silver iodide content may be maintained, or the silver iodide content may be increased or decreased continuously, or the silver iodide content may be varied at a certain point.

The reaction temperature in the mixer vessel is preferably from 0° C. to 60° C., more preferably from 0° C. to 50° C., especially preferably 0° C. to 40° C.

If the reaction temperature is 35° C. or lower, a low molecular weight gelatin (mean molecular weight: 30,000 or less) is preferably used since general gelatin would solidify with ease at such low temperature.

The temperature of the protective colloid in the reactor vessel is preferably from 40° C. to 95° C., more preferably from 50° C. to 95° C., and most preferably from 60° C. to 95° C.

The process of the present invention is extremely effective for preparation of various silver halide emulsions.

In preparation of silver iodide-containing emulsion by growth of silver halide grains of silver iodobromide, silver iodobromochloride or silver iodochloride, if the grains are prepared by conventional methods, there occurs microscopic non-uniformity of silver iodide in the grains formed. Even when an aqueous halide solution having a constant iodine composition and an aqueous silver salt solution are added to a reactor vessel for conducting grain growth therein, the microscopic non-uniformity of silver iodide in the resulting grains is inevitable. The microscopic non-uniform distribution of silver iodide in the grains may easily be checked by observing the transmitted images of the silver halide grains with a transmission electromicroscope.

For instance, the grains may be observed by the direct method at a low temperature with a transmission electromicroscope as described in J. F. Hamilton, *Photographic Science and Engineering,* Vol. 11 (1967) at page 57, and in T. Shiozawa, *Journal of Japan Photographic Association,* Vol. 35, No. 4, (1972), at page 213. Briefly, silver halide grains are taken out under a safelight so that these are not printed out, these are put on a mesh for electromicroscopic observation, and these are observed by transmission electromicroscopic method with cooling with a liquid nitrogen or liquid helium so that the sample may be protected from damage by electron rays (for example, printing out with such rays).

The accelerated voltage of the electromicroscope to be used in the method is better to be higher so as to obtain a sharper microscopic image. Concretely, the voltage is preferably 200 KV for grains having a thickness of up to 0.25 μm, and it is preferably 1000 KV for grains having a thickness larger than 0.25 μm. If the accelerated voltage becomes higher, the damage of the grains by the irradiated electron rays increases. Accordingly, it is desired that the sample be cooled with liquid nitrogen rather than liquid helium when the voltage is high.

The magnification is generally from 20,000 times to 40,000 times, although it may be varied in accordance with the grain size of the grains to be observed.

Figure 3:
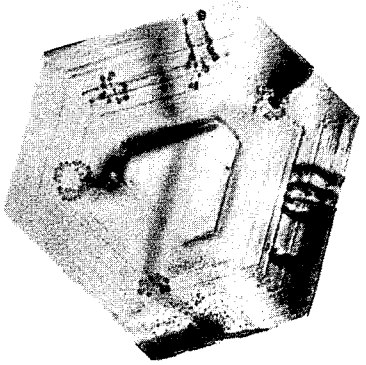
FIG. 3 is a photograph by a transmission electro-microscope with magnification of 20,000 times, which shows the crystal structure of tabular silver halide grains prepared by a conventional method.

For instance, when tabular silver iodobromide grains are photographed by transmission electromicroscopy, fine annular ring-like stripe patterns are observed in the portion of silver iodobromide phase. One example of the pattern is shown in FIG. 3. The tabular grains shown in FIG. 3 are tabular core-shell grains prepared by forming a silver iodobromide shell (silver iodide: 10 mol %) around a tabular silver bromide grain core, and the structure of the grains may distinctly be observed by the transmission electromicroscopic photograph. Precisely, the core part is silver bromide and is naturally uniform, which is therefore seen as a uniformly flat image. On the other hand, extremely fine annular ring-like stripe patterns are clearly confirmed in the silver iodobromide phase. It is noted that the interval between the respective stripes in the pattern is extremely fine and small or is in an order of 100 Å or less and the stripes are microscopically extremely non-uniform. The extremely fine stripe patterns indicate the non-uniformity of the silver iodide distribution in the grains, which may be clarified by various methods. More directly, when the tabular grains are annealed under the condition that the iodide ion may transfer in the silver halide crystals (for example, at 250° C. for 3 hours), the stripe patterns disappear. From this observation, the non-uniformity may be properly concluded.

The annular ring-like stripe patterns are not observed at all in the tabular grains prepared by the process of the present invention, but silver halide grains having a completely uniform silver iodide distribution can be obtained. The position of the silver iodide-containing phase in the silver halide grain may be localized in any part of the grain. For example, the silver iodide-containing phase may be localized in the center part or peripheral part of the grain or the phase may be throughout the grain. The number of the silver iodide-containing phases in the grain may be one or plural.

The silver iodide content in the silver iodobromide phase or silver iodochlorobromide phase contained in the emulsion grains prepared by the process and the apparatus of the prescnt invention is from 3 to 45 mol %, preferably from 5 to 35 mol %. The total silver iodide content in the grain is generally 2 mol % or more, but it is preferably 5 mol % or more. More preferably, it is 7 mol % or more, and most preferably 12 mol % or more the upper limit of the total silver iocicle content in preferably 40 mol %.

The process of the present invention is also effective in the preparation of silver chlorobromide grains. In accordance with the process of the invention, silver chlorobromide grains having a completely uniform silver bromide (or silver chloride) distribution can be obtained.

Further, the process of the present invention is also extremely effective in preparation of pure silver bromide or pure silver chloride grains. In conventional manufacturing methods, the existence of local distribution of silver ion and halogen ion in the reactor vessel was inevitable in the preparation of pure silver bromide or pure silver chloride grains. In these cases, the silver halide grains in the reactor vessel would have to pass through a locally non-uniform part and therefore would be subject to conditions different from other uniform parts of the reactor vessel. Accordingly, non-uniformity in the growth of the grains resulted therefrom. Moreover, a reduced silver or fogged silver would thereby be formed in the part of the vessel having a high silver ion concentration. The thus prepared silver bromide or silver chloride grains would therefore cause another non-uniformity such as a reduced silver or foggen silver, although these would free from the non-uniform distribution of the halides themselves. This problem can completely be solved by the process of the present invention.

The silver halide grains of the present invention can be used in a surface latent image-type emulsion, but may also be used in an internal latent image-forming type emulsion or a direct reversal emulsion.

In general, internal latent image-forming type silver halide grains are superior to surface latent image-forming type grains, for the following reasons.

(1) Silver halide crystal grains have a space charge layer formed therein, and the electrons generated by light absorption move towards the inside of the grain while the photoholes more towards the surface thereof. Accordingly, if a latent image site (electron-trapping site) or a light-sensitive nucleus is provided in the inside of the grain, the re-bonding of the electron and the photohole may be prevented., so that the latent image formation may be achieved in a highly efficient manner. Accordingly, a high quantum sensitivity may be realized.

(2) Since the light-sensitive nucleus is in the inside of the grain, the stability of the nucleus is not influenced by water or oxygen. Accordingly, the storability is excellent.

(3) Since the latent image to be formed by exposure is also in the inside of the grain, the image is also not influenced by water or oxygen. Accordingly, the latent image stability is also extremely high.

(4) When a sensitizing dye is adsorbed on the surface of the grains and the emulsion is color-sensitized, the light absorbing site (sensitizing dye site on the surface of the grain) and the latent image site (internal light-sensitive nucleus site) are separate from each other, so that the re-bonding of the dye photohole and electron may be prevented. Accordingly, a so-called intrinsic desensitization due of color-sensitization does not occur, so that a high color-sensitized sensitivity can be realized.

Thus, internal latent image-forming type grains have various advantages compared to the surface latent image-forming type grains. However, the former have a difficulty that the light-sensitive nuclei of the grains can hardly be incorporated (embedded) into the inside of the grains. In order to embed the light-sensitive nucleus into the inside of the grain, a core grain is formed first and then is chemically sensitized to form a light-sensitive nucleus on the surface of the core. Afterwards, a silver halide is deposited on the core to form a so-called shell thereover. However, the light-sensitive nucleus on the surface of the core grain formed by the chemical sensitization of the core often is deteriorated in the subsequent step of shell formation, which causes internal fog. One reason for this is that in conventional methods, the shell formation on the core is effected in the part with a non-uniform concentration with respect to silver ion concentration and halogen ion concentration so that the resulting light-sensitive nuclei are easily converted into fogged nuclei. The problem may be overcome by the process of the present invention, and internal latent image-forming type silver halide emulsions which are substantially free from internal fogging may be obtained. The internal latent image-forming type silver halide grains are preferably normal crystalline or tabular grains. Specifically, these are silver chlorobromide or silver chloroiodobromide grains having a silver bromide, silver iodobromide or silver chloride content of 30 mol % or less. Preferably, these are silver iodobromide grains having a silver iodide content of 10 mol % or less.

In this case, the molar ratio of core/shell may be varied, but it is preferably $\frac{1}{2}$ to 1/20, more preferably from $\frac{1}{3}$ to 1/10.

In place of the internal chemically-sensitized nuclei or together with them, a metal ion may be doped in the inside of the grains. The position to be doped may be the core part, the core/shell interfacial part or the shell part of the grain.

As examples of metal dopants to be used for this purpose, there may be mentioned a cadmium salt, a lead salt, a thallium salt, an erbium salt, a bismuth salt, an iridium salt, a rhodium salt or complex salts thereof. The metal ion is generally used in a proportion of $10^{-6}$ to $10^{-2}$ mol or more per mol. of the silver halide contained in the grain.

The size of the completely uniform silver halide grains prepared by the process of the present invention is not specifically limited but it is preferably 0.3 μm or more, more preferably 0.8 μm or more, and most preferably 1.4 μm or more. The upper limit is preferably 10 μm.

Regarding the shape of the silver halide grains of the present invention, the grains may have a regular crystalline form such as hexahedral, octahedral, dodecahedral, tetradecahedral, tetracosahedral or octatetracontahedral crystalline form (normal crystalline grains), or may have an irregular crystal form such as spherical or potato-like crystalline form, or they may be grains of various shapes having one or more twin planes, for example, hexagonal tabular grains or triangular tabular twin grains having two or three parallel twin planes.

The silver halide grains thus prepared by the process and the apparatus of the present invention the following advantages.

(1) In the case of silver iodide-containing silver halide grains, the silver iodide distribution is completely uniform and the grain size distribution is narrow.

(2) In the case of silver chlorobromide grains, the silver bromide distribution is completely uniform.

(3) In the case of silver bromide or silver chloride grains, the amount of reduced silver or fogged silver in the inside or surface of the grain is insubstantial.

Due to the above-mentioned merits, the present invention provides a negative type silver halide emulsion having excellent characteristics in terms of sensitivity, gradation, graininess, sharpness, storability and pressure-resistance.

When an internal latent image-forming type silver halide emulsion is prepared by the process and the apparatus of the present invention, the emulsion also has excellent photographic characteristics of high sensitivity and high $D_{max}$ value.

The following examples are intended to illustrate the present invention in more detail but not to limit it in any way.

Unless stated otherwise, all parts, percents, ratios, etc. are by weight.

EXAMPLE 1

Preparation of Emulsion (1-A) Containing Fine Silver Iodobromide Grain 1,200 ml of 1.2M silver nitrate solution and 1,200 ml of an aqueous halide solution containing 1.08 M potassium bromide and 0.12M potassium iodide were added to 2.6 liters of a 2.0 wt % gelatin solution containing 0.026 M potassium bromide, with stirring by the double jet method, over a period of 15 minutes, whereupon the gelatin solution was kept at 35° C. Afterwards, the resulting emulsion was washed by a conventional flocculation method, 30 g of gelatin were added thereto and dissolved, and then the emulsion was adjusted to have a pH of 6.5 and a pAg of 8.6. The thus obtained fine silver iodobromide grains (silver iodide content: 10%) had a mean grain size of 0.07 μm.

Preparation of Tabular Silver Bromide Nuclear Grains (1-B)

150 ml of 2.0 M silver nitrate solution and 150 ml of 2.0 M potassium bromide solution were added to 1.3 liters of 0.8 wt % gelatin solution containing 0.08 M potassium bromide, with stirring by the double jet method, whereupon the gelatin solution was kept at 30° C. After the addition, the temperature of the solution was elevated to 70° C. and 30 g of gelatin were added thereto. Afterwards, this was ripened for 30 minutes.

The thus formed tabular silver bromide grains which are to be nuclei (hereinafter referred to as seed crystals) were washed by a conventional flocculation method, and these were then adjusted to have a pH of 6.0 and a pAg of 7.5 at 40° C. The mean project area circle-corresponding diameter of the thus obtained tabular grains was 0.4 μm.

Preparation of Tabular Silver Iodobromide Emulsion (1-C) (Comparative Emulsion)

1/10 of the aboved-mentioned seed crystals were dissolved in one liter of a solution containing 3 wt % of gelatin, and the resulting solution was adjusted to have a temperature of 75° C. and a pBr value of 1.4. Afterwards, 1 g of 3,6-dithioctane-1, 8-diol were added thereto, and immediately 800 ml of an aqueous solution containing 150 g of silver nitrate and 800 ml a potassium bromide solution containing 10M % of potassium iodide were added thereto by a double jet method under the condition of an equimolecularly accelerated flow rate (the final flow rate was 10 times of the initial flow rate), over a period of 80 minutes.

Afterwards, the resulting emulsion was cooled to 35° C. and washed by conventional flocculation method. Then this was adjusted to have a pH value of 6.5 and a pAg value of 8.6 at 40° C. and stored in a cold dark place (temperature: 5° C.).

Preparation of Tabular Silver Iodobromide Emulsion (1-D) (Comparative Emulsion)

Emulsion (1-D) was prepared in the same manner as preparation of Emulsion (1-C) except that 3,6-dithioctane-1,8-diol was not added.

Preparation of Tabular Silver Iodobromide Emulsion (1-E) (Comparative Emulsion):

1/10 of Seed Emulsion (1-B) was dissolved in one liter of a solution containing 3 wt % of gelatin and the resulting solution was kept to have a temperature of 75° C. and a pBr value of 1.4. Afterwards, 1 g of 3,6-dithioctane-1,8-diol was added thereto, and immediately after the dissolved fine grains-containing Emulsion (1A) was added thereto by a pump. The addition speed condition was same as that in preparation of Emulsion (1-C), whereby Emulsion (1-A) was injected into the seed crystal Emulsion (1-B) by a pump over a period of 80 minutes. The total amount of Emulsion (1-B) added was 150 g as silver nitrate, and the final flow rate was 10 times of the initial flow rate. Then, the resulting emulsion was washed with water in the same manner as the case of Emulsion (1-C), and this was adjusted to have a pH of 6.5 and a pAg of 8.6 at 40° C. The mean project area circle-corresponding diameter of the thus formed tabular grains was 2.2 μm and the mean grain thickness thereof was 0.3 μm.

Preparation of Tabular Silver Iodobromide Emulsion (1-F) (Comparative Emulsion)

Emulsion (1-F) was prepared in the same manner as the preparation of Emulsion (1-E) except that 3,6-dithioctane-1,8-dithiol was not added.

Preparation of Tabular Silver Iodobromide Emulsion (1-G) (Emulsion of the Invention)

Emulsion (1-G) was prepared in the same manner as the preparation of Emulsions (1-C) and (1-E), except that the fine grains formed in the mixer vessel were immediately added to the reactor vessel in the step of growing the grains, as mentioned below.

800 ml of an aqueous solution containing 150 g of silver nitrate, the same molar amount of potassium bromide solution (800 ml) containing 10 mol % of potassium iodide and 500 ml of an aqueous 3 wt % gelatin solution were added to the mixer vessel provided near the reactor vessel, under the condition of an accelerated flow rate whereby the final flow rate was 10 times of the initial flow rate by a triple jet method, over a period of 80 minutes. The resistance time of the thus added solutions in the mixer vessel was 10 seconds. The rotary speed of the stirring blades in the mixer vessel was 3,000 r.p.m. The thus formed fine silver iodobromide grains were observed with a direct transmission electromicroscope with 20,000 times magnification and were found to have a mean grain size of 0.01 μm. The temperature in the mixer vessel was kept at 35° C., and the fin grains formed in the mixer vessel were continuously introduced into the reactor vessel.

Preparation of Tabular Silver Iodobromide Emulsion (1-H) (Emulsion of the Invention Emulsion (1-H) was prepared in the same manner as the preparation of Emulsion (1-G) except that 3,6-dithioctane-1,8-dithiol was not added.

Characteristics of the tabular grains of the emulsions prepared above are shown in Table 1 below.

TABLE 1

| | Mean Projected Area Circle-corresponding Diameter (μm) | Coefficient of Variation of Circle-corresponding Diameter (%) | Proportion of Hexagonal Tabular Grains(*) (%) | Thickness of Tabular Grains (μm) | Note | Remarks |
|---|---|---|---|---|---|---|
| 1-C | 2.1 | 21 | 75 | 0.26 | — | Comparative Emulsion |
| 1-D | 2.2 | 23 | 75 | 0.24 | — | Comparative Emulsion |
| 1-E | 2.6 | 46 | 78 | 0.22 | — | Comparative Emulsion |
| 1-F | 1.8 | — | — | — | Fine Grains Remained. | Comparative Emulsion |
| 1-G | 2.1 | 21 | 82 | 0.26 | — | Emulsion of the Invention |
| 1-H | 2.2 | 18 | 86 | 0.23 | — | Emulsion of the Invention |

Note (*): These are hexagonal tabular grains described in JP-A-63-151618.

The tabular silver iodobromide grains prepared by the process of the present invention had a narrower grain size distribution and a higher proportion of hexagonal tabular grains than those in Comparative Emulsion (1-E) prepared from the previously formed fine grains-containing emulsion. Since Emulsion (1-F) had no silver halide solvent, dissolution of the fine grains was relatively slow and the grain growth was incomplete. As a result, noticeable fine grains still remained in the final emulsion.

Grains of Emulsions (1-C), (1-E) and (1-G) were sampled and these were photographed with a 200 KV transmission electro-microscope (magnification: 20,000 times), with cooling using liquid nitrogen, to obtain the transmitted images. The results (photographs) are shown in FIGS. 4A, 4B and 4C, respectively.

The grains shown in these figures had silver bromide as a core and contained no silver iodide. Accordingly, non-uniform stripe patterns were not observed. The outer ring or shell part is a silver iodobromide phase containing 10 mol % of silver iodide and the core/shell ratio is ½.

Figure 4A:
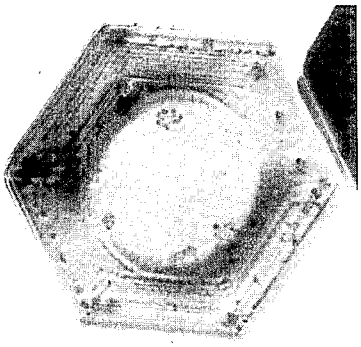
FIGS. 4A, 4B and 4C are photographs by a transmission electro-microscope with magnification of 20,000 times, which show the crystal structures of silver halide grains in Emulsions (1-C), (1-E) and (1-G), respectively, prepared in Example 1.
Figure 4B:
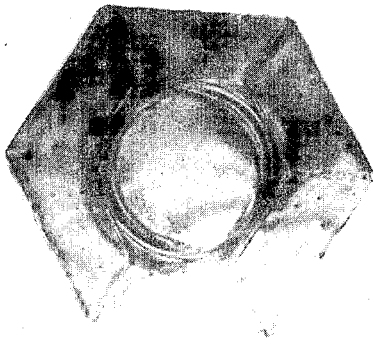
Figure 4C:
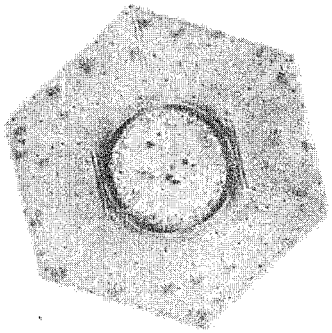

A distinct annular ring-like stripe pattern is observed in FIG. 4A (Emulsion (1-C)), while such pattern is not observed in FIGS. 4B and 4C (Emulsions (1-E) and (1-G)) at all. It is therefore understood that tabular silver iodobromide emulsions having a completely uniform silver iodide distribution were obtained. Emulsion (1-E) surely had a completely uniform silver iodide distribution, but the grain size distribution thereof was extremely broad, as indicated in Table 1 above. Accordingly, it is understood that tabular silver iodobromide grains having both a narrow grain size distribution and a completely uniform silver iodide distribution can be obtained only by the process of the present invention.

250 mg/mol Ag of Sensitizing Dye (I) mentioned below was added to each of Emulsions (1-C) to (1-H), except (1-F), having a pH of 6.5 and a pAg of 8.6, at 60° C. Ten minutes after the addition, sodium thiosulfate, potassium chloroaurate and potassium thiocyanate were added thereto for optimum chemical sensitization. After chemical sensitization, 100 g of each of Emulsions (1-B) to (1-D) (containing 0.08 mol of Ag) were melted at 40° C. and the following compounds (1) to (3) were added thereto in order with stirring to give a coating composition.

Sensitizing Dye (I):

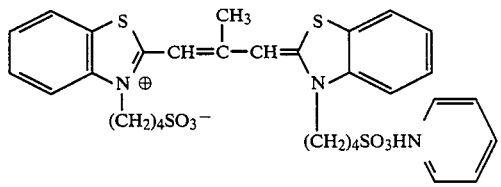

| | | |
|---|---|---|
| (1) 4-Hydroxy-6-methyl-1,3,3a,7-tetrazaindene | 3% | 2 ml |
| (2) $C_{17}H_{35}—O—(CH_2CHO)_{25}—H$ | 2% | 2.2 ml |
| (3) 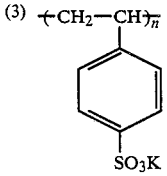 | 2% | 1.6 ml |

(n = ca. 3000)

Next, the following substances (1) to (5) were blended in order with stirring at 40° C., to give a surface protective layer-coating composition.

| | | |
|---|---|---|
| (1) 14% Aqueous Gelatin Solution | | 56.8 g |
| (2) Fine Polymethyl Methacrylate Grains (mean grain size 3.0 μm, average molecular weight = 1,000,000) | | 3.9 g |
| (3) Emulsion: | | |
| Gelatin | 10% | 4.24 g |

-continued

| | | |
|---|---|---|
| $NaO_3S-CH(CH_2COOCH_2CH(C_2H_5)C_4H_9)COOCH_2CH(C_2H_5)C_4H_9$ | | 10.6 mg |
| 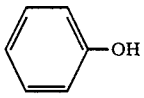 | 72% | 0.02 ml |
| 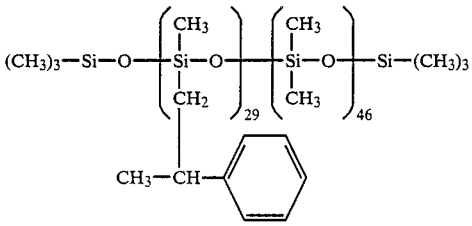 | | 0.424 g |
| (4) $H_2O$ | | 68.8 ml |
| (5) 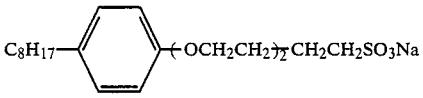 | 4.3% | 3 ml |

The thus prepared emulsion-coating composition and surface protective layer-coating composition were coated on a cellulose triacetate film support by a co-extrusion method, the volume ratio of the coated layers being 103/45. The amount of silver coated was 3.1 g/m$^2$. The samples thus prepared were wedgewise exposed with a light source (200 lux) having a color temperature of 2,854° K for 1/10 second and then developed with Developer (D-1) mentioned below at 20° C. for 7 minutes. These were then fixed with Fixer (F-1), rinsed with water and dried.

| | |
|---|---|
| Developer (D-1): | |
| Metol (P—methylaminophenol sulfate) | 2 g |
| Sodium Sulfite | 100 g |
| Hydroquinone | 5 g |
| Borax.5$H_2O$ | 1.53 g |
| Water to make | 1 liter |
| Fixer (F-1): | |
| Ammonium Thiosulfate | 200.0 g |
| Sodium Sulfite (Anhydride) | 20.0 g |
| Boric Acid | 8.0 g |
| Ethylenediamine-tetraacetic Acid Disodium Salt | 0.1 g |
| Aluminum Sulfate | 15.0 g |
| Sulfuric Acid | 2.0 g |
| Glacial Acetic Acid | 22.0 g |
| Water to make | 1 liter |
| (pH was adjusted to 4.2.) | |

The results of sensitometry were shown in Table 2 below.

TABLE 2

| Emulsion | Relative Sensitivity | Fog | —* G | Note |
|---|---|---|---|---|
| 1-C | 100 | 0.16 | 0.90 | Comparative Emulsion |
| 1-D | 100 | 0.15 | 0.95 | Comparative Emulsion |
| 1-E | 210 | 0.16 | 0.60 | Comparative Emulsion |
| 1-G | 270 | 0.15 | 0.90 | Emulsion of the Invention |
| 1-H | 270 | 0.14 | 0.90 | Emulsion of the Invention |

TABLE 2-continued

*: G represents an inclination between the point of fog + 0.1 and the point of fog + 0.11.

From the results in Table 2, it can be seen that Emulsions (1-G) and (1-H) of the present invention have extremely high sensitivity compared to the conparative emulsions. Emulsion (1-E) had a higher sensitivity, but the graininess of Emulsion (1-E) was inferior to that of the emulsions of the present invention and the gradation was low contrast.

EXAMPLE 2

Preparation of Octahedral Silver Iodobromide Grain Emulsion (2-A) (Comparative Emulsion)

80 ml of a methanol solution of 0.1% 3,4-dimethyl-4-thiazoline-2-thione were added to 1.2 liters of 3.0 wt % gelatin solution containing0.06M potassium bromide with stirring in a reactor vessel and the content was kept at 75° C. To this were added 50 ml of a 0.3M silver nitrate solution and 50 ml of an aqueous halide solution containing 0.063M potassium iodide and 0.19M potassium bromide by a double jet method, over a period of 3 minutes. Silver iodobromide grains having a project area circle-corresponding diameter of 0.3 μm and a silver iodide content of 25 mol % were obtained by nucleation. Subsequently, 800 ml of 1.5M silver nitrate and 800 ml of a halide solution containing 0.375 M potassium iodide and 1.13M potassium bromide were simultaneously added thereto in the same manner also by a double jet method, over a period of 100 minutes at 75° C. Afterwards, the resulting emulsion was cooled to 35° C. and washed with water by a conventional flocculation method. 70 g of gelatin were added thereto, and the emulsion was adjusted to have a pH of 6.2 and a pAg of 8.8. The thus obtained grain emulsion was an octahedral silver iodobromide emulsion having a mean project area circle-corresponding diameter of 1.7 μm and a silver iodide content of 25 mol %.

Next, the emulsion was used as a core emulsion, and a shell of silver bromide was formed over the core. The molar ratio of core/shell in the resulting grains was 1/1. The thus obtained emulsion grains were monodispersed core/shell octahedral grains having a mean circle-corresponding diameter of 2.2 μm and a core silver iodide content of 25 mol %. Preparation of Fine Silver Iodobromide Grain Emulsion (2-B):

1,200 ml of 1.2M silver nitrate solution and 1,200 ml of an aqueous halide solution containing 0.9M potassium bromide and 0.3M potassium iodide were added to 2.6 liters of a 2.0 wt % gelatin solution containing 0.026M potassium bromide with stirring by a double jet method, over a period of 15 minutes, whereupon the gelatin solution was kept at 35° C. Afterwards, the resulting emulsion was washed by a conventional flocculation method and 30 g of gelatin were added thereto. After dissolution, the emulsion was adjusted to have a pH of 6.5 and a pAg of 8.6. The thus prepared fine silver iodobromide grains had a mean grain size of 0.06 μm and a silver iodide content of 25 mol %. Preparation of Emulsion (2-C) (Comparative Emulsion):

Nucleation was effected in the same manner as in the preparation of Emulsion (2-A) to obtain silver iodobromide grain nuclei having a grain size of 0.3 μm. Subsequently, fine grains-containing Emulsion (2-B) (silver iodide content: 25 mol %) was added thereto in an amount of 1.2 mol as silver, with a pump over a period of 100 minutes. Afterwards, the emulsion was cooled and washed with water, and this was adjusted to have the same pH and pAg values as those of Emulsion. (2-A). Next, the emulsion grains were used as core grains, and a silver nitrate solution and a potassium bromide solution were simultaneously added thereto in the reactor vessel by a double jet method to form silver bromide shell over the core grains. Core/shell (1/1) grains were formed. These were monodispersed core/shell octahedral grains having a mean circle-corresponding diameter of 1.8 μm and having a silver iodide core of 25 mol %. However, a part of the fine grains added still remained in the resulting emulsion and some tabular grains formed therein.

Preparation of Emulsion (2-D)(Emulsion of the Invention)

Nucleation was effected in the same manner as in preparation of Emulsion (2-A), and 800 ml of 1.5M silver nitrate solution, 800 ml of a mixed solution comprising 0.375M potassium iodide and 1.13M potassium bromide and 800 ml of 3 wt % aqueous gelatin solution were added to the resulting nuclei in the mixer vessel provided near the reactor vessel, by a triple jet method over a period of 100 minutes. The residence time of the solutions added in the mixer vessel was 5 seconds. The rotation speed of the stirring blades of the mixer vessel was 6,000 r.p.m. The thus formed fine grains were observed with a direct transmission electromicroscope with 20,000 times magnification and were found to have a grain size of 0.01 μm. The temperature in the mixer vessel was kept at 33° C. The ultra-fine grains formed in the mixer vessel were introduced into the reactor vessel kept at 75° C. Afterwards, 800 ml of 1.5 M silver nitrate solution, 800 ml of 1.5M potassium bromide and 800 ml of 2 wt % gelatin solution were added to the mixer vessel over a period of 50 minutes to form a silver bromide shell over the core grain. Thus, core/shell (1/1) grains were obtained. The fine grains formed in the mixer vessel had a grain size of 0.02 μm. The rotary speed of the stirring blades in the mixer vessel was 3,000 r.p.m., and the temperature was kept at 40° C. The thus prepared grains were octahedral core/shell grains having a circle-corresponding diameter of 2.2 μm and a core silver iodide content of 25 mol %. As is understood from the results of Emulsion (2-C), when the silver iodide content of the fine silver iodobromide grains becomes up to 25 mol %, the solubility of the grains noticeably decreases so that the dissolution speed thereby decreases. As a result, the grains would undergo Ostwald ripening while they are growing, so that they would finally grow to tabular grains. In accordance with the process of the present invention, as opposed to this, since the grain size is extremely small, the dissolution speed is rapid, so that the grains having the same grain size as those in Emulsion (2-A) were obtained.

Each of Emulsions (2-A), (2-C) and (2-D) was optimally chemically sensitized with sodium thiosulfate, potassium chloroaurate and potassium thiocyanate, and then the following compounds were added thereto. The thus formed coating composition was coated on a subbing layer having a triacetyl cellulose film support.

(1) Emulsion Layer:
(a) Emulsion: See Table 4
(b) Coupler:

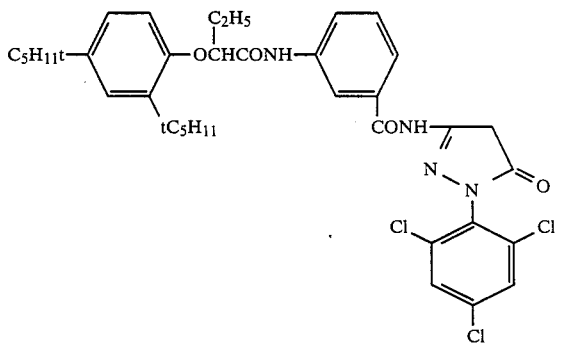

(c) Tricresyl phosphate
(d) Sensitizing Dye:
Sodium 5-chloro-5r-phenyl-4pethyl-3,3'-(3-sulfopropyl)-oxacarbocyanine
(e) Stabilizer:
4-Hydroxy-6-methyl-1,3,3a,7-tetrazaindene
(f) Coating Aid:
Sodium dodecylbenzenesulfonate
(2) Protective Layer:
(a) Sodium 2,4-dichloro-6-hydroxy-s-triazine
(b) Gelatin These samples were sensitometrically exposed and then processed by the color development procedure mentioned below.

The density of the thus processed samples was measured with a green filter. The results of the photographic properties of the samples were shown in Table 3 below.

| | |
|---|---|
| 1. Color Development | 2 min 45 sec |
| 2. Bleaching | 6 min 30 sec |
| 3. Rinsing in Water | 3 min 15 sec |
| 4. Fixation | 6 min 30 sec |
| 5. Rinsing in Water | 3 min 15 sec |

-continued

| | |
|---|---|
| 6. Stabilization | 3 min 15 sec |

The processing solutions used in the respective steps were as follows.

| | |
|---|---|
| Color Developer: | |
| Nitrilotriacetic Acid Sodium Salt | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—ethyl-N—β-hydroxylethylamino)-2-methylaniline Sulfate | 4.5 g |
| Water to make | 1 liter |
| Bleaching Solution: | |
| Ammonium Bromide | 160.0 g |
| Aqueous Ammonia (28 wt %) | 25.0 ml |
| Ethylenediamine-tetraacetic Acid Sodium Salt | 130 g |
| Glacial Acetic Acid | 14 ml |
| Water to make | 1 liter |
| Fixer: | |
| Tetrapolyphosphoric Acid Sodium Salt | 2.0 g |
| Sodium Sulfite | 4.0 g |
| Ammonium Thiosulfate (70 wt %) | 175.0 ml |
| Sodium Bisulfite | 4.6 g |
| Water to make | 1 liter |
| Stabilizer: | |
| Formalin | 8.0 ml |
| Water to make | 1 liter |

TABLE 3

| Emulsion | Relative Sensitivity | Fog | Note |
|---|---|---|---|
| 2-A | 100 | 0.15 | Comparative Emulsion |
| 2-C | 120 | 0.19 | Comparative Emulsion |
| 2-D | 150 | 0.12 | Emulsion of the Invention |

From the results in Table 3, it can be seen that Emulsion (2-D) of the present invention is superior to the comparative emulsions with respect to sensitivity and fog. Precisely, Emulsion (2-C) had a higher sensitivity than Emulsion (2-A), but the graininess of Emulsion (2-C) was inferior to that of Emulsion (2-A) and Emulsion (2-D) since Emulsion (2-C) contained a noticeable amount of tabular grains.

Next, the pressure characteristics of the samples were tested by a bending test of the emulsion-coated films. As a result, pressure desensitization was found to be extremely remarkable in the case of Emulsion (2-A). However, almost no pressure desensitization was found in the cases of Emulsion (2-C) and Emulsion (2-D). Accordingly, extreme improvement against pressure desensitization was attained in the latter two emulsions. In summary, Emulsion (2-D) of the present invention was excellent in terms of high sensitivity, low fog and good graininess, and the pressure characteristics were advantageously improved.

EXAMPLE 3

Preparation of Octahedral Silver Iodobromide Emulsion (3-A) (Comparative Emulsion)

80 ml of 5% 3,6-dithioctane-1,8-diol were added to 1.2 liters of 3.0 wt % aqueous gelatin solution containing 0.03M of potassium bromide with stirring, and 500 ml of an aqueous solution containing 100 g of silver nitrate and 500 ml of an aqueous solution containing 70 g of potassium bromide were simultaneously added thereto at 75° C. by a double jet method. Thus, monodispersed octahedral silver bromide grains having a grain size of 1.7 μm were obtained. Subsequently, these grains were used as cores, and 400 ml of 1.5M aqueous silver nitrate solution and 400 ml of an aqueous halide solution containing 0.15M potassium iodide and 1.35M potassium bromide were simultaneously added thereto by a double jet method over a period of 50 minutes. The cores were coated with silver iodobromide shell having a silver iodide content of 10 mol %. Afterwards, the resulting emulsion was cooled to 35° C. and washed with water by a conventional flocculation method. 85 g of gelatin were added thereto, and the emulsion was adjusted to have a pH of 6.2 and a pAg of 8.8. The thus prepared grains were monodispersed core/shell octahedral grains having a mean project area circle-corresponding diameter of 2.2 μm, a silver iodide content (in shell) of 10 mol % and a core/shell ratio of 1/1.

Preparation of Emulsion (3-B)

Cores having a mean circle-corresponding diameter of 1.7 μm were prepared in the same manner as in the preparation of Emulsion (3-A). Subsequently, 20 ml of 30% potassium bromide were added thereto, and fine grain emulsion (1-A) having a silver iodide content of 10 mol % was also added thereto in an amount of 0.6 mol (as silver), via a pump over a period of 50 minutes at a constant speed. Thus, a core/shell grain emulsion was prepared in the same manner as the preparation of Emulsion (3-A). The thus prepared core/shell (1/1) grains had a mean circle-corresponding diameter of 2.4 μm and had a silver iodide content (in shell) of 10 mol %. These were octahedral grains with rounded corners, having a broad grain size distribution.

Preparation of Emulsion (3-C)

Silver bromide core grains having a mean circle-corresponding diameter of 1.7 μm were prepared in the same manner as the preparation of Emulsion (3-A). Then 400 ml of 1.5M aqueous silver nitrate solution, 400 ml of aqueous halide solution containing 0.15M potassium iodide and 1.35M potassium bromide and 500 ml of 2 wt % aqueous gelatin solution were simultaneously added to the mixer vessel provided near the reactor vessel, by a triple jet method over a period of 50 minutes. The residence time of the solutions added in the mixer vessel was 10 seconds, and the rotation speed of the stirring blades in the mixer vessel was 3,000 r.p.m. The thus formed fine grains were observed with a direct transmission electromicroscope with 20,000 times magnification and were found to have a grain size of 0.02 μm. The temperature in the mixer vessel was kept at 35° C. The ultra-fine grains formed in the mixer vessel were continuously introduced into the reactor vessel kept at 75° C. The thus obtained grains were monodispersed core/shell (1/1) octahedral grains in which the core was silver bromide and the shell was silver iodobromide with silver iodide content of 10 mol %. The mean circle-corresponding diameter of the grains was 2.2 μm.

Emulsions (3-A), (3-B) and (3-C) were optimally chemically sensitized with sodium thiosulfate, potassium chloroaurate and potassium thiocyanate. Using the emulsion, photographic material samples were prepared in the same manner as Example 2. The samples were sensitometrically tested also in the same manner as in Example 2. The results of the photographic characteristics of the samples obtained by the tests are shown in Table 4 below. In addition, the characteristics of the emulsion grains are shown in Table 5 below.

TABLE 4

| Emulsion | Relative Sensitivity | Fog | Note |
|---|---|---|---|
| 3-A | 100 | 0.15 | Comparative Emulsion |
| 3-B | 250 | 0.18 | Comparative Emulsion |
| 3-C | 350 | 0.15 | Emulsion of the Invention |

TABLE 5

| Emulsion | Shape of Grains | Mean Grain Size (μm) | Coefficient of variation of Grain Size Distribution (%) | Note |
|---|---|---|---|---|
| 3-A | Octahedral | 2.2 | 8 | Comparative Emulsion |
| 3-B | Octahedral with Roundish Corners | 2.4 | 17 | " |
| 3-C | Octahedral | 2.2 | 8 | Emulsion of the Invention |

As is obvious from the results in Table 5, the grains in Comparative Emulsion (3-B) were rounded, as opposed to those in Comparative Emulsion (3-A), and Emulsion (3-C) of the present invention and the coefficient of variation of the grain size distribution was extremely large in the former compound to that in the latter due to the following reasons. In the preparation of the comparative emulsions, previously prepared fine grains (grain size: 0.05 μm) were used so that the solubility of the grains was lower than the ultra-fine grains used for the preparation of Emulsion (3-C) of the present invention. Accordingly, the fine grains would remain as such if these were processed under the same condition of using the ultra-fine grains. Accordingly, 20 ml of 30% potassium bromide were added in the preparation of Emulsion (3-B) to increase the solubility of the reaction system and the dissolution speed of the fine grains. Instead, this causes supersaturation in the grain growing system. As a result, the grains would undergo Ostwald ripening so that the resulting grain would have a broadened grain size distribution. As opposed to such a mechanism, it is unnecessary to elevate the solubility of the reaction system in preparation of Emulsion (3-C) of the present invention, unlike the case of preparation of comparative Emulsion (3-B), since the grain size of the fine grains used is extremely small. As a result, the shape and the grain size distribution of the grains in Emulsion (3-C) are same as those of the grains in Emulsion (3-A).

From the results in Table 4, it is noted that Emulsion (3-C) has an extremely higher sensitivity than Emulsions (3-B) and (3-A). Since Emulsion (3-B) had a broader grain size distribution, the graininess thereof was poor.

EXAMPLE 4

Preparation of Internal Latent Image-Forming Type Tabular Grain Direct Reversal Emulsion (4-A) (Comparative Emulsion)

50 ml of 0.7M silver nitrate solution and 50 ml of 0.7M potassium bromide solution were added to one liter of 3.0 wt % gelatin solution containing 0.07 M potassium bromide, with stirring at 30° C. by a double jet method, over a period of one minute, and then the whole was heated to 75° C. 0.6M silver nitrate solution was added thereto and this was adjusted to have a pBr value of 2.6. Then 600 ml of 1.47M silver nitrate solution and 600 ml of 1.47M potassium bromide solution were added thereto at an accelerated flow rate whereby the final flow rate was 19 times of the initial flow rate by a double jet method, whereupon the pBr value of the reaction system was 2.6. The resulting emulsion was washed by a conventional flocculation method, and dispersing gelatin was added thereto. 1200 g of a core emulsion were obtained. The thus formed tabular grains contained 90% of hexagonal tabular grains described in JP-A-63-151618. The mean project area-corresponding diameter of the grains was 1.3 μm and the coefficient of variation thereof was 15%. The grains were monodispersed tabular grains, and the mean grain thickness was 0.14 μm.

800 ml of $H_2O$ and 30 g of gelatin were added to 200 g of the core emulsion and dissolved, and the temperature of the solution was elevated up to 75° C. Further, 30 ml of 0.1 wt % 3,4-dimethyl-1,3-thiazoline-2-thione were added to the emulsion, and 3 mg of sodium thiosulfate and 1 mg of potassium chloroaurate were further added thereto and heated for 70 minutes at 70° C. for chemical sensitization. To the thus chemically sensitized core emulsion were added 520 ml of. 1.47M silver nitrate solution and 520 ml of 1.47M silver bromide solution by a double jet method at an accelerated flow rate whereby the final flow rate was 19 times of the initial flow rate in the same manner as in the case of preparing the core emulsion. The resulting emulsion was washed by a conventional flocculation method and 50 g of dispersing gelatin were added thereto. 1,200 g of a core/shell emulsion were obtained. The thus formed tabular grains had a mean project area circle-corresponding diameter of 2.6 μm and a mean grain thickness of 0.23 μm. These tabular grains contained 83% of the grains described in JP-A-63-151618, and the coefficient of variation was 16%.

Next, 0.2 mg of sodium thiosulfate and 10 mg of poly(N-vinylpyrrolidone) were added to the core/shell type emulsion and heated at 60° C. for 50 minutes so that the surfaces of the grains were chemically sensitized.

Preparation of Emulsion (4-B) (Comparative Emulsion)

Tabular silver bromide grains which are to be cores were prepared in the same manner as the preparation of Emulsion (4-A), and these were chemically sensitized also in the same manner as in the case of Emulsion (4-A). Afterwards, a fine silver bromide grain emulsion which was not chemically sensitized was blended with the grains and the resulting mixture was ripened so as to form a shell over the cores, following the method described in U.S. Pat. Nos. 3,317,322 and 3,206,313. Specifically, a fine silver bromide emulsion having a mean project area circle-corresponding diameter of 0.07 μm was added to the previously chemically ripened core grains in an amount containing 0.76 mol of silver bromide, and the core grains were ripened at 75° C. until all the fine grains were dissolved therein, whereby a shell was formed over each core grain. Afterwards, the surface of the thus formed core/shell grains was sensitized in the same manner as the case of Emulsion (4-A).

Preparation of Emulsion (4-C)

Tabular silver bromide grains which are to be cores were prepared in the same manner as in the preparation of Emulsion (4-A), and these were chemically sensitized also in the same manner as in the case of Emulsion (4-A). Afterwards, 520 ml of 1.47M silver nitrate solution, 520 ml of 1.47M potassium bromide solution and 800 ml of 3 wt % aqueous gelatin solution were injected into the mixer vessel provided near the reactor vessel, at an accelerated flow rate whereby the final flow rate was 4 times of the initial flow rate by a triple jet method. The residence time of the solutions added in the mixer vessel was 20 seconds at the initial stage and 5 seconds at the final stage. The rotation speed of the stirring blades in the mixer vessel was 6,000 r.p.m., and the mixer vessel was kept at 35° C. The grains formed in the mixer vessel were observed with a direct transmission microscope with 20,000 times magnification and were found to have a grain size of 0.02 μm. The ultra-fine grains thus formed in the mixer vessel were continuously introduced into the reactor vessel at 75° C. The resulting emulsion was cooled and washed with water by conventional flocculation method. Then, the surface of the thus formed core/shell emulsion grains was chemically sensitized in the same manner as in the case of Emulsion (4-A).

The characteristics of the tabular grains of the thus formed emulsions (4-A), (4-B) and (4-C) are shown in Table 6 below.

TABLE 6

| Emulsion | Mean Project Area Circle-Corresponding Diameter (μm) | Coefficient of variation of Circle-Corresponding Diameter (%) | Proportion of Hexagonal Tabular Grains (*) (%) | Thickness of Grains (μm) | Note |
|---|---|---|---|---|---|
| 4-A | 2.6 | 16 | 83 | 0.23 | Comparative Emulsion |
| 4-B | 2.8 | 24 | 81 | 0.21 | Comparative Emulsion |
| 4-C | 2.6 | 15 | 83 | 0.23 | Emulsion of the present Invention |

Note(*): These are hexagonal tabular grains described in JP-A-63-151618.

As is obvious from Table 6 above, Emulsions (4A) and (4-C) contained monodispersed hexagonal tabular grains, while Emulsion (4-B) was not a monodispersed emulsion since the coefficient of variation of the circle-corresponding diameter in Emulsion (4-B) was 24%. In accordance with the method described in U.S. Pat. Nos. 3,317,322 and 3,206,313, the grains could not uniformly grow in formation of the shell part over the core grains and, as a result, tabular grains having non-uniform grain sizes were formed. Formation of such non-uniform grains is extremely disadvantageous in the preparation of internal latent image-forming type emulsions since it is necessary to coat the light-sensitive nucleus on the core grain with the same shell having the same thickness in the preparation of internal latent image-forming type emulsions.

Preparation of Light-Sensitive Sheet

Layers (1) to (6) each having the composition mentioned below were formed on a transparent polyethylene terephthalate support to prepare Light-sensitive Sheet (A).

Layer (6):
Gelatin-Containing Protective Layer

Layer (5):
Red-sensitive Core/Shell Type Direct Positive Emulsion Layer

Layer (4):
Cyan DRR Compound-Containing Layer

Layer (3):
Light-Shielding Layer

Layer (2):
White Reflective Layer

Layer (1):
Mordant Layer

Support:

The layers comprised the following compositions:

Layer (1):
Mordant layer containing 3.0 g of the following polymer (described in U.S. Patent 3,898,088) and 3.0 mg/m$^2$ of gelatin.

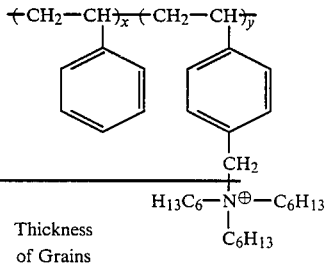

x:y = 50:50 (by ml)

Layer (2):
White-reflective layer containing 20 g/m$^2$ of titanium oxide and 2.0 g/m$^2$ of gelatin.

Layer (3):
Light-shielding layer containing 2.0 g/m$^2$ of carbon black and 1.5 g/m$^2$ of gelatin.

Layer (4):
Layer containing 0.44 g/m$^2$ of the following cyan DRR compound, 0.9 g/m$^2$ of tricyclohexyl phosphate and 0.8 g/m$^2$ of gelatin.

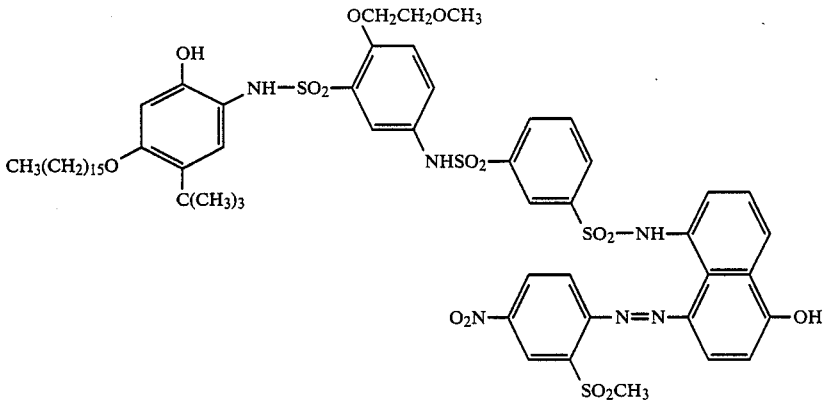

Layer (5):

Red-sensitive core/shell type direct positive silver bromide emulsion layer containing the previously prepared Emulsion (4-A, 4-B or 4-C) (0.81 g/m$^2$ as silver), a red-sensitive sensitizing dye represented by the following formula and as a nucleating agent, 0.01 mg/m$^2$ of 1-formyl-2-[4-{3-(3-phenylthioureido)benzamido]phenyl]hydrazine, 4.3 mg/m$^2$ of 4-hydroxy-6-methyl-1,3,3a,7-tetrazaindene and 0.11 g/m$^2$ of sodium 5-pentadecyl-hydroquinone-2-sulfonate.

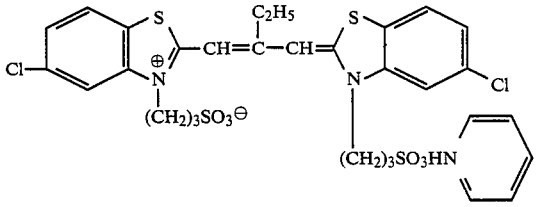

Layer (6):

Protective layer containing 1.0 g/m$^2$ of gelatin.

The thus prepared light-sensitive sheet was combined with the following photographic elements and exposed and developed. The photographic characteristics ($D_{max}$, $D_{min}$, re-reversal sensitivity) of the thus processed samples were measured.

| Composition of Processing Solution: | |
|---|---|
| 1-p-tolyl-4-methyl-4-hydroxymethyl-3-pyrazolidone | 12.0 g |
| Methylhydroquinone | 0.3 g |
| 5-Methylbenzotriazole | 3.5 g |
| Sodium Sulfite | 2.0 g |
| Carboxymethyl Cellulose Sodium Salt | 58 g |
| Potassium Hydroxide | 56 g |
| Benzyl Alcohol | 1.5 g |
| Carbon Black Dispersion (25%) | 600 g |
| Water to make | 1 liter |

0.8 g of the processing solution having the above-mentioned composition were packed in a container which may be broken under pressure.

Preparation of Cover Sheet

The following layers (1') to (3') were coated in order on a transparent polyethylene terephthalate support to prepare a cover sheet.

Layer (1'):

Neutralizing Layer containing 22 g/m$^2$ of a copolymer of acrylic acid/butyl acrylate (80/20, by weight) and 0.44 g/mz of 1,4-bis(2,3-epoxypropoxy)-butane.

Layer (2'):

Layer containing 3.8 g/m$^2$ of acetyl cellulose (capable of forming 39.4 g of acetyl group by hydrolysis of 100 g of acetyl cellulose), 0.2 g/m$^2$ of copolymer of styrene/maleic anhydride (60/40, by weight) (molecular weight: about 50,000) and 0.115 g/m$^2$ of 5-(β-cyanoethylthio)-1-phenyltetrazoee.

Layer (3'):

Layer containing 2.5 g/m$^2$ of copolymer latex of vinylidene chloride/methyl acrylate/acrylic acid (85/12/3, by weight) and 0.05 g/m$^2$ of polymethyl methacrylate latex (grain size: 1 to 3 μm).

Exposure and development of the samples were effected as follows.

The cover sheet and the light-sensitive sheet were combined, and these were wedgewise exposed to xenon flash from the side of the cover sheet through a continuous gradation wedge, for $10^{-2}$ seconds. Then, the combined sheets were pressed with a pressure roller, so that the processing solution was spread between the both sheets at a thickness of 75 μm. The treatment was conducted at 25° C. One hour after the treatment, the density of the cyan color in the transferred image formed on the mordant layer (image-receiving layer) was measured through the transparent support of the light-sensitive sheet with a Macbeth Reflection Densitometer.

The results obtained were shown in Table 7 below.

TABLE 7

| Emulsion | Red-sensitive Sensitizing Dye | Dmax | Relative Reversal Sensitivity (D = 0.5) | Relative Re-reversal Sensitivity (D = 0.5) | Note |
|---|---|---|---|---|---|
| 4-A | No | 1.7 | 70 | * | Comparative Emulsion |
| 4-A | Yes | 2.0 | 100 | * | Comparative Emulsion |
| 4-B | No | 1.9 | 70 | * | Comparative Emulsion |
| 4-B | Yes | 2.2 | 100 | 0.5 | Comparative |

TABLE 7-continued

| Emulsion | Red-sensitive Sensitizing Dye | Dmax | Relative Reversal Sensitivity (D = 0.5) | Relative Re-reversal Sensitivity (D = 0.5) | Note |
|---|---|---|---|---|---|
| | | | | | Emulsion |
| 4-C | No | 1.9 | 80 | * | Emulsion of the Invention |
| 4-C | Yes | 2.3 | 120 | * | Emulsion of the Invention |

Note (*): No re-reversal was observed in the employed exposure range.

As is obvious from the results in Table 7, Emulsion (4-C) prepared by the process of the present invention had an increased $D_{max}$ and a higher sensitivity than Emulsion (4-A). On the other hand, Emulsion (4-B) had an increased $D_{max}$ compared to Emulsion (4-A), while the re-reversed image was noticeably increased in the former. Such defect is caused by the insufficiency in the formation of the internal latent image in the emulsion because of the non-uniformity in the shell formation in the core/shell grains therein, as mentioned hereinbefore.

Emulsion (5-C) of the present invention was free from the re-reversed image, unlike Emulsion (5-B), and had a comparatively high $D_{max}$ and a high sensitivity.

While the invention has been described in detail and with reference to specific embodiments thereof, it will be apparent to one skilled in the art that various changes and modifications can be made therein without departing from the spirit and scope thereof.

What is claimed is:

1. A process for manufacturing silver halide grains, which comprises the steps of:

(A) providing a mixer vessel and a reactor vessel, said mixer vessel being separate from said reactor vessel and said reactor vessel having contained therein an aqueous protective colloid solution and in which silver halide grains are grown;

(B) feeding an aqueous water-soluble silver salt solution, an aqueous water-soluble halide solution and an aqueous protective colloid solution into said mixer vessel;

(C) forming a fine silver halide grain-containing solution by mixing the thus fed solutions in said mixer vessel;

(D) immediately feeding the thus formed fine silver halide grain-containing solution into said reactor vessel; and (E) stirring said solution in said reactor vessel to grow uniform silver halide grains therein.

2. A process according to claim 1, wherein said silver salt solution, said halide solution and said protective colloid solution are present in said mixer vessel for a period of time as expressed by the following formula:

$$t = \frac{v}{a + b + c} \quad \text{(I)}$$

wherein t is the residence time of any one of said solutions in said mixer vessel; v is the volume of said mixer vessel (ml); a is the amount of said silver salt solution added (ml/min); b is the amount of said halide solution added (ml/min); and c is the amount of said protective colloid added (ml/min).

3. A process according to claim 2, wherein said residence time is 10 minutes or less.

4. A process according to claim 2, wherein said residence time is 5 minutes or less.

5. A process according to claim 2, wherein said residence time is 1 minutes or less.

6. A process according to claim 2, wherein said residence time is 20 seconds or less.

7. A process according to claim 1, wherein said silver salt solution, said halide solution and said protective colloid solution are injected into said mixer vessel simultaneously.

8. A process according to claim 1, wherein said protective colloid solution is singly fed into said mixer vessel.

9. A process according to claim 1, wherein said protective colloid solution is mixed with said halide solution prior to feeding into said mixer vessel.

10. A process according to claim 1, wherein said protective colloid solution is mixed with said silver salt solution prior to feeding into said mixer vessel.

11. A process according to claim 8, wherein said protective colloid solution is added to said mixer vessel at a flow rate of at least 20% of the sum of the flow rates of said silver salt solution and said halide solution to said mixer vessel.

12. A process according to claim 1, wherein said protective colloid solution comprises gelatin.

13. A process according to claim 1, wherein said mixer vessel is maintained at a temperature of from 0° C. to 60° C.

* * * * *